US009468322B2

(12) United States Patent
Woo

(10) Patent No.: US 9,468,322 B2
(45) Date of Patent: Oct. 18, 2016

(54) CHOPSTICKS WITH A HINGE MECHANISM

(71) Applicant: Chat Ming Woo, Hong Kong (HK)

(72) Inventor: Chat Ming Woo, Hong Kong (HK)

( * ) Notice: Subject to any disclaimer, the term of this patent is extended or adjusted under 35 U.S.C. 154(b) by 0 days.

(21) Appl. No.: 14/787,269

(22) PCT Filed: Apr. 25, 2013

(86) PCT No.: PCT/CN2013/074680
§ 371 (c)(1),
(2) Date: Oct. 27, 2015

(87) PCT Pub. No.: WO2014/172862
PCT Pub. Date: Oct. 30, 2014

(65) Prior Publication Data

US 2016/0066726 A1 Mar. 10, 2016

(51) Int. Cl.
*A47G 21/10* (2006.01)
*A47G 21/06* (2006.01)

(52) U.S. Cl.
CPC ..... *A47G 21/103* (2013.01)

(58) Field of Classification Search
CPC ..... A47G 21/103
USPC ..... 294/218, 99.2, 16, 25
See application file for complete search history.

(56) References Cited

U.S. PATENT DOCUMENTS 4,973,095 A 11/1990 Kunihisa
6,581,997 B1 * 6/2003 Martikainen ..... A47G 21/103 294/218
7,182,378 B2 2/2007 Inomata et al.
8,042,851 B2 * 10/2011 Lai Martinez ..... A47G 21/103 294/218
8,562,054 B2 * 10/2013 Keller ..... A47G 21/103 294/218
2012/0133167 A1 5/2012 Woo

FOREIGN PATENT DOCUMENTS

| | | | |
|---|---|---|---|
| CN | 1953686 | A | 4/2007 |
| CN | 201088421 | Y | 7/2008 |
| EP | 2462847 | A1 | 6/2012 |
| GB | 2065454 | A | 7/1981 |
| GB | 2065454 | B | 7/1981 |
| JP | N51-110877 | U | 2/1976 |
| JP | 2007-532231 | A | 11/2007 |
| KR | 20-0253470 | U | 11/2001 |
| KR | WO2006/004290 | A1 | 1/2006 |
| KR | 2020090001430 | A | 2/2009 |
| TW | 201230990 | A1 | 8/2012 |
| WO | WO 03/015589 | A1 | 2/2003 |
| WO | WO2005/099527 | A1 | 10/2005 |
| WO | WO2011/015033 | A1 | 2/2011 |

* cited by examiner

*Primary Examiner* — Gabriela Puig

(57) ABSTRACT

Chopsticks comprise a lower chopstick member (20), an upper chopstick (10) and a hinge mechanism. The hinge mechanism comprises a hinge arranged on the lower chopstick member (20) and a hinge hole (102) in the upper chopstick member (10). The hinge comprises a hinge head (130) which can be received into the hinge hole (102), and the hinge hole (102) is provided with a pivot (164) that can be received within the inner chamber (132) of the hinge head (130), so that the hinge can turn around the pivot (164). The upper chopstick member (10) is provided with a swell portion (104), in which the hinge hole (102) is located, and the swell portion (104) extends from the front surface of the upper chopstick member (10) and/or the back surface of the upper chop stick member (10), therefore, the whole strength of the chopsticks is increased.

16 Claims, 6 Drawing Sheets

CHOPSTICKS WITH A HINGE MECHANISM

TECHNICAL FIELD

The invention relates to chopsticks, in particular to chopsticks with a hinge mechanism for connecting two chopstick members.

BACKGROUND

For a history of three thousand years, Chinese people have been using chopsticks for eating. FIGS. 1 and 2 show a kind of conventional chopsticks, consisting of a rod-shaped upper chopstick member 10 and a rod-shaped lower chopstick member 20. The head 18 of the upper chopstick member and the head 28 of the lower chopstick member are used for gripping food. The tails 19 and 29 of the two chopstick members are opposite of the heads 18 and 28, respectively. The surfaces of the upper chopstick member and the lower chopstick member which touch the thumb are called the front surfaces 11, 21 (see FIG. 1); the surfaces on the top are called the top surfaces 12, 22; the surfaces opposite to the front surfaces are called the back surfaces 13, 23 (see FIG. 2); and the surfaces on the bottom (not shown) are called the bottom surfaces. The side of the thumb near to the direction of the radius bone of the forearm is called the radial side 33 of the thumb, and the side of the thumb near to the direction of the ulna bone of the forearm is called the ulnar side 34 of the thumb. For the chopsticks having cross-sections other than square or rectangle, it is readily understood that the chopsticks can be similarly deemed as having the above-mentioned surfaces.

The correct chopstick holding status is shown in FIG. 1. When the chopsticks are correctly held, the first section 61 of the ring finger supports the back of the lower chopstick member, the base 48 (and the location therebelow) of the third section 43 of the index finger touches the back surface of the lower chopstick member, and the second section 32 of the thumb presses the front surface of the lower chopstick member. Thus the lower chopstick member 20 is firmly gripped through the three regions, so that it cannot be movable relative to the hand. In contrast, the upper chopstick member 10 is movable. The first section 41 of the index finger together with the first section 51 of the middle finger grips the upper chopstick member, allowing an up-and-down motion, such that the upper chopstick member 10 can open and close towards the lower chopstick member 20, achieving the function of food gripping. The third section 43 of the index finger touches the back of the upper chopstick member. The first section 31 of the thumb presses the front surface of the upper chopstick member. The two sections 31, 32 of the thumb should not move relative to the lower chopstick member.

Currently, in order to hold the chopsticks in a more stable manner, some chopsticks are provided with a hinge mechanism for connecting the upper and the lower chopstick members. An example can be found in FIG. 3. Specifically, as shown in FIG. 3, the lower chopstick member 20 is provided with a hinge, which consists of a column 121 vertically extending from the lower chopstick member 20 and a hinge head, i.e., a C-shaped element 122, located at the top of the column 121. The upper chopstick member 10 is provided with a hinge hole 92, which is a through hole but with a pivot (not shown) arranged therein, the longitudinal axis of the pivot being perpendicular to that of the upper chopstick member 10. In assembly status, the pivot of the upper chopstick member 10 is received within the inner chamber 123 of the C-shaped element 122, so that the C-shaped element 122 can turn around the pivot. In this way, the two chopstick members are connected with one another but can still be opened or closed relative to each other. Therefore, the chopsticks can be held in a more stable manner.

However, there are two major problems in this kind of structure. On one hand, the hinge hole 92 reduces the thickness of the front wall 91 and back wall 93 of the upper chopstick member 10, which are rather thin per se. On the other hand, the thickness of the C-shaped element 122 is also undesirably limited by the size of the hinge hole 92, so that the C-shaped element 122 cannot be designed with a large size. The thin walls 91, 93 of the upper chopstick member 10 together with the thin C-shaped element 122 result in a fragile structure.

Moreover, in use the two chopstick members form a lever, so that the torque exerted on the hinge would be significant. When the chopsticks are abusively used (especially by children), this torque is even greater. In this case, a fragile hinge would be broken easily. Broken parts pose potentially serious risk of ingestion and choking injuries, and may lead to suffocation and death of children, and sicknesses for both children and adults as well. Also, the breakage may produce hazardous points and sharp edges which damage the body, such as the skins and eyes of users, both children and adults. It is difficult to pass the torque tests required by safety regulations in many countries.

SUMMARY OF THE INVENTION

The invention aims to provide chopsticks with a hinge mechanism, which can facilitate the correct holding of chopsticks but still with sufficient strength.

The present invention provides chopsticks, comprising a lower chopstick member, an upper chopstick member and a hinge mechanism connecting the lower and upper chopstick members. The hinge mechanism comprises a hinge arranged on the lower chopstick member and a hinge hole in the upper chopstick member, the opening of the said hinge hole being arranged on the bottom surface of the upper chopstick member. The hinge comprises a hinge head which is provided with an inner chamber and can be received into said hinge hole through the said opening of the hinge hole, and the hinge hole is provided with a pivot that can be received in the inner chamber, so that the hinge can turn around the pivot. And the upper chopstick member is provided with a swell portion, in which the hinge hole is located, and the swell portion extends from the front surface of the upper chopstick member and/or the back surface of the upper chopstick member.

In an embodiment, the swell portion extends from the upper chopstick member at a distance of more than 1 mm, in particular more than 2 mm.

In an example, the hinge hole is designed so that at the chopsticks holding status, the third section of the index finger is positioned within the region of the hinge hole.

In another example, the swell portion is located on the front surface of the upper chopstick member between the first section of the thumb and the tail of the upper chopstick member at chopstick holding status. In a further example, the swell portion extends from the front surface of the upper chopstick member, and is arranged so that at the chopsticks holding status, it contacts ulnar side of the thumb.

Preferably, the hinge head is a C-shaped element or a ring-shaped element. In addition, the inner chamber formed in the hinge head has a height greater than the height of the pivot. Preferably, the inner chamber has a height at least 1 mm, in particular at least 2 mm, greater than the height of the pivot, so that the pivot can move up and down at least such distance.

In another example, the upper chopstick member is further provided with two separated projections extending from the bottom of the front wall and back wall of the hinge hole, and the pivot is arranged between the two projections.

In a further example, the pivot is mounted on the front wall and/or the back wall of the hinge hole.

In a further example, the hinge head is supported by a hinge rod extending from the top surface of the lower chopstick member.

Preferably, the total thickness of the front wall and back wall of the hinge hole and the hinge head is greater than the thickness of the upper chopstick element.

In a further example, the hinge head does not protrude from the top surface of the upper chopstick element.

In a further example, the swell portion extends rearwardly from back surface of the upper chopstick member, and is located between first section of the middle finger and the third section of the index finger at chopstick holding status.

In another example, the swell portion is formed integrally with the upper chopstick member by injection molding. Preferably, the head and tail of the hinge head are both thinner than the hinge hole.

According to the present invention, in the chopsticks holding status: the first section of the ring finger supports the back of the lower chopstick member; the base and the location therebelow of the third section of the index finger touches the back surface of the lower chopstick member; the second section of the thumb presses the front surface of the lower chopstick member; the third section of the index finger touches the back surface of the upper chopstick member; the first section of the index finger together with the first section of the middle finger grips the upper chopstick member; and the first section of the thumb presses the front surface of the upper chopstick member.

According to the present invention, the upper chopstick member is provided with a swell portion, in which the hinge hole is located. Therefore, the thickness of the upper chopstick member is enhanced, such that a larger hinge hole can be formed in the upper chopstick member. In other words, the thickness of the hinge hole can be increased. Also, since the hinge hole can be made larger, the hinge head in the lower chopstick member can have a larger size. Therefore, the whole strength of the chopsticks is significantly increased, and the risk that the hinge would be broken is reduced. Hence, it is beneficial for the safety of the product, especially for children. Also, it is easier to pass the torque tests required by safety regulations in many countries.

BRIEF DESCRIPTION OF THE DRAWINGS

Embodiments of the present invention can be better understood with reference to the attached Figures. It is understood that these Figures are only provided for illustrating the present invention in a convenient manner, and the present invention is not limited to the specific structures and arrangements as shown in the Figures.

DETAILED DESCRIPTION OF EMBODIMENTS

In the followings the present invention will be described in details with reference to the Figures. It should be noted that in the following the term "chopstick holding status" is defined as that described in Background section of the present disclosure. The definitions of upper chopstick element, lower chopstick element, and the front, back, top, bottom surfaces, and head, tail end of chopsticks, and the positions of the hands are also defined as those in Background section.

Figure 1:
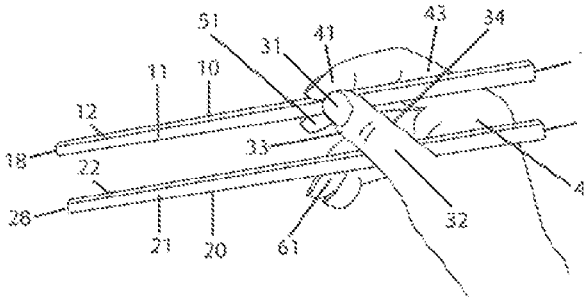
FIG. 1 and FIG. 2 show the front side and the back side of the correct chopsticks holding posture respectively.
Figure 2:
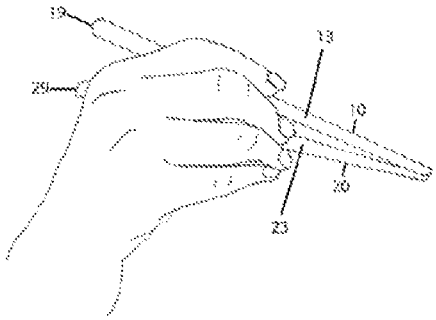
Figure 3:
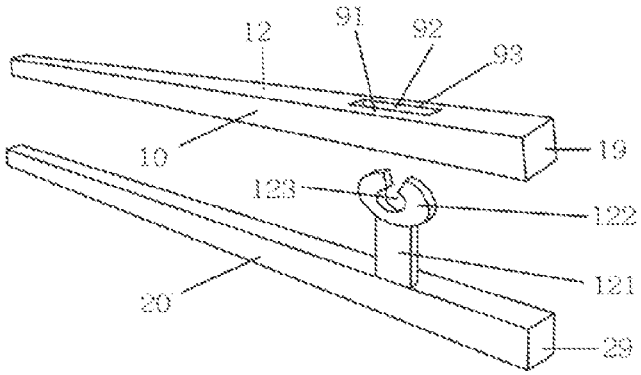
Fig. 3 (Prior Art)
FIG. 3 shows traditional chopsticks with a hinge for connecting the upper and lower chopstick members.
Figure 4:
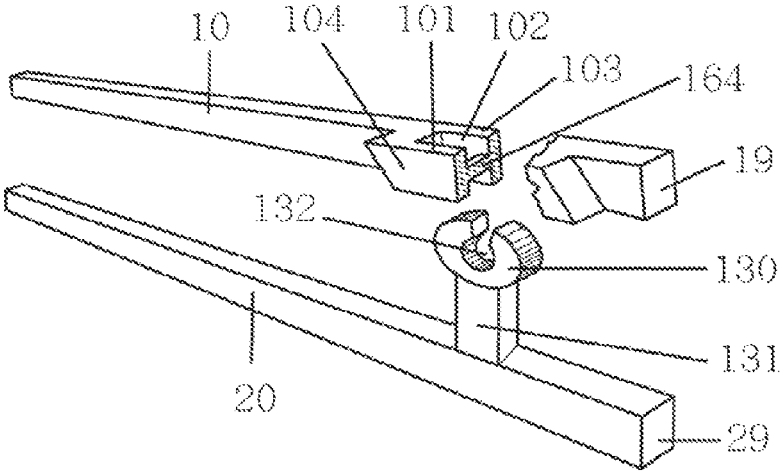
FIG. 4 shows the chopsticks according to an embodiment of the present invention, wherein the lower chopstick member is provided with a hinge and the upper chopstick member is provided with a swell portion including a hinge hole for receiving the hinge.

FIG. 4 shows an embodiment of the chopsticks with a hinge mechanism according to the present invention, wherein the upper chopstick member is shown in a cut-open state. In this embodiment, the chopsticks comprise an upper chopstick member 10 and a lower chopstick member 20. The lower chopstick member 20 is provided with a hinge, which consists of a connecting element 131 vertically extending from the top surface of the lower chopstick member 20 and a hinge head located at the top of the connecting element 131. In this example, the hinge head is implemented as a C-shaped element 130. The connecting element 131 as shown is in the form of a rod, but it may be in other form as long as it can connect the C-shaped element 130 and the lower chopstick member 20. The C-shaped element 130 defines an inner chamber 132 with an opening.

The upper chopstick member 10 is provided with a swell portion 104, which extends forwardly from the front surface of the upper chopstick member 10. In the region of the swell portion 104, the upper chopstick member 10 includes a hinge hole 102 having an opening arranged on the bottom surface of the upper chopstick member 10, wherein the hinge head 130 can be received in the hinge hole 102 through the opening. More specifically, a pivot 164 is arranged between the front wall 101 and the rear wall 103 of the hinge hole 102, so that the C-shaped element 130 can hook onto the pivot 164, i.e., the pivot 164 is received within the inner chamber 132 of the C-shape element 130, and thus the C-shaped element 130 can turn around the pivot 164.

In this embodiment, the pivot 164 and the C-shaped element 130, when in the assembled state, are located inside the hinge hole 102. This structure results in several advantages. On one hand, the outward appearance of the chopsticks is good, because the hinge head 130, which may be ugly, is covered by the front wall 101 of the hinge hole 102. On the other hand, the hinge head 130 does not have to protrude at a long distance from the top of the upper chopstick element 10, so that it will not hinder the motion of the index finger, and reduce the chance to give the index finger a bad sense of touch. In a particular example, the top of the hinge head doesn't protrude from the top surface of the upper chopstick element.

Figure 5:
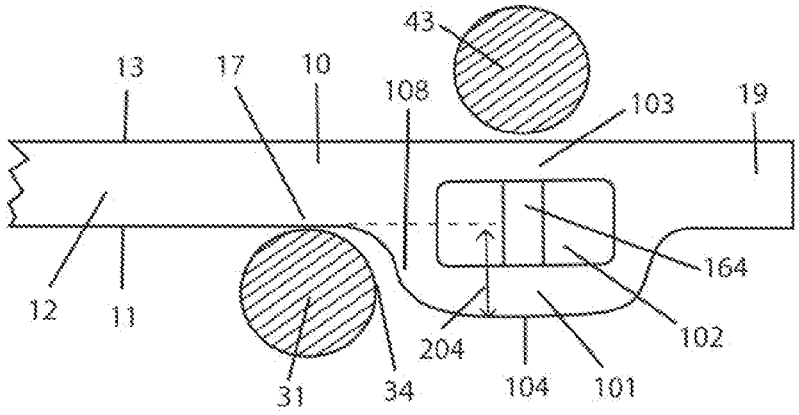
FIG. 5 is a top view showing the swell portion of FIG. 4 in detail.

FIG. 5 is the top view of the upper chopstick member 10 of FIG. 4 at chopsticks holding status, wherein the first section 31 of the thumb and the third section 43 of the index finger are schematically shown with hatched circles. The swell portion 104 protrudes forwardly from the front surface 11 of the upper chopstick member with a length 204. Preferably, this length 204 is longer than 1 mm, in particular longer than 2 mm.

With this swell portion 104, the thickness of the front wall 101, the thickness of the back wall 103, and the thickness of the hinge hole 102 are increased. Also, since the hinge hole can be made larger, the hinge head 130 can have a larger size. Therefore, the whole strength of the chopsticks is significantly increased, and the risk that the hinge or the upper chopstick element would be broken is reduced. Hence, it is beneficial for the safety of the product, especially for children. Also, it is easier to pass the torque tests required by safety regulations in many countries.

For example, when such a swell portion does not exist, a chopstick for child may be as thin as 6 mm. When the hinge hole 102 is e.g. 2 mm in thickness and the front wall 101 and the back wall 103 are both 2 mm, the C-shaped element (i.e., the hinge head) can have a thickness of 2 mm at most. Such a thin version of walls and the C-shaped element are prone to breakage.

On the contrary, when a swell portion with a thickness of 6 mm is provided (i.e., the length 204 is 6 mm), the upper chopstick member 10 would be thickened to 12 mm. Accordingly, the hinge hole, the two walls and the C-shaped element may have a thickness ranged from 2 to 4 mm. This thickened version of the C-shaped element (i.e., the hinge head) and two walls are more durable and less possible to break. The size for adult versions may be enlarged proportionally.

Figure 6:
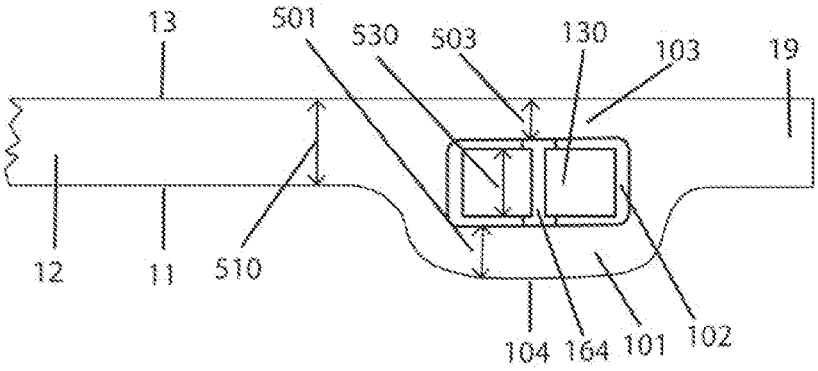
FIG. 6 schematically shows the sizes of different parts of the swell portion.

FIG. 6 illustrates the size of different parts of one embodiment. The thickness denoted by 501, 503, and 530 are the thickness of the front wall 101, the back wall 103 and the C-shaped element respectively. The thickness 510 is the thickness of the upper chopstick member 10. Optionally, the sum of the thickness 501, 503, and 530 is greater than the thickness 510, preferably by at least 1 mm, in particular by at least 2 mm.

Preferably, this swell portion 104 is configured so that it is located between the ulnar side 34 of the first section 31 of the thumb and the tail 19 of the upper chopstick member 10 at chopstick holding status (see FIG. 5). In this case, the swell portion 104 can protrude with any length without affecting the thumb.

Figure 20:
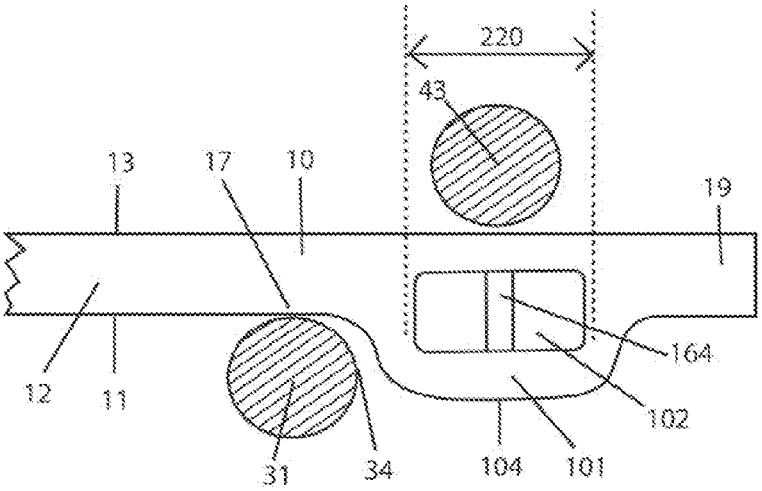
FIG. 20 shows a particular example of the position of the hinge hole.

Alternatively or additionally, as shown in FIG. 20, at chopstick holding status, the third section 43 of the index finger is positioned within the region 220 of the hinge hole. In such a position, the upper chopstick member 10 can be held at a comfortable position as the upper chopstick member moves up or down. This is because, in the chopstick holding status, the third section 43 of the index finger and the first section 31 of the thumb together form a natural hinge, and the first section 41 of the index finger and the first section 51 of the middle finger moves the head 18 of the upper chopstick member 10 up and down (see the explanation on the chopstick holding status in the portion of Background). If the hinge hole 102 is located in other positions, such as at the tail 19 of the upper chopstick member 10, the center of rotation of the upper chopstick member 10 would be undesirably located at this position (which is not the position of the natural hinge between the thumb and the index finger), thus causing an uncomfortable feeling for the upper chopstick member.

Optionally, the swell portion 104 can be designed such that at chopsticks holding status (see FIG. 5), the head 108 of the swell portion 104 contacts the ulnar side 34 of the thumb, and thus blocks the first section 31 of the thumb from moving toward the tail 19 of the upper chopstick member. In this manner, the first section 31 of the thumb cannot be too close to the tail 19 of the upper chopstick member, which would facilitate a correct chopsticks holding.

Figure 7:
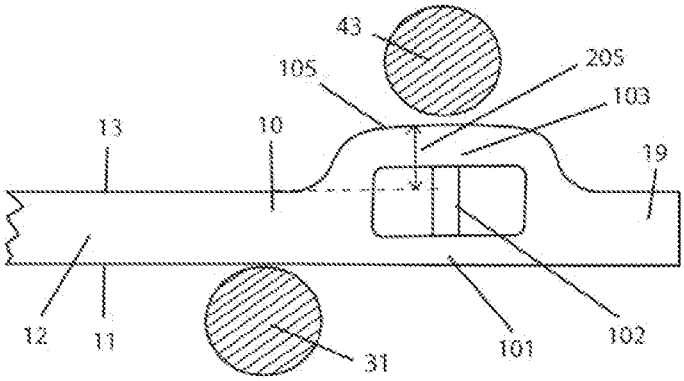
FIGS. 7 and 8 show two variants of the swell portion of FIG. 4.
Figure 8:
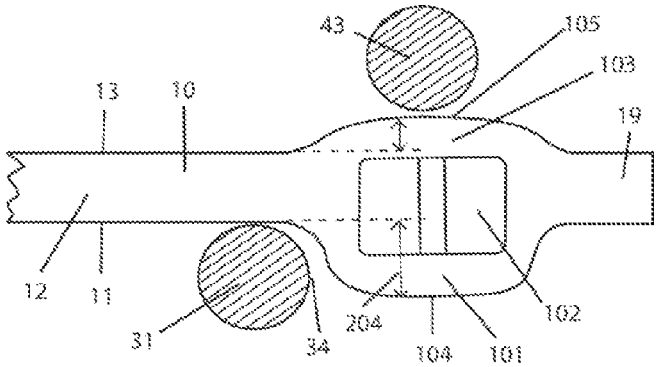

FIGS. 7 and 8 show two variants of the swell portion of FIG. 5 respectively. In the example shown in FIG. 7, the swell portion 105 extends rearwardly from the back surface 13 of the upper chopstick member 10 at a distance 205. This swell portion 105 can also function as enlarging the thickness of the upper chopstick member 10, and thus increasing the whole strength of the chopsticks. Preferably, the distance 205 is more than 1 mm, in particular more than 2 mm. Further, in the example shown in FIG. 8, the upper chopstick member 10 is provided with both of the swell portion 104 and the swell portion 105 at the same time. In this way, the whole strength of the chopsticks is further increased. Preferably, the swell 104 and/or 105 are formed as single body with the upper chopstick element by injection molding, for better strength.

Figure 19:
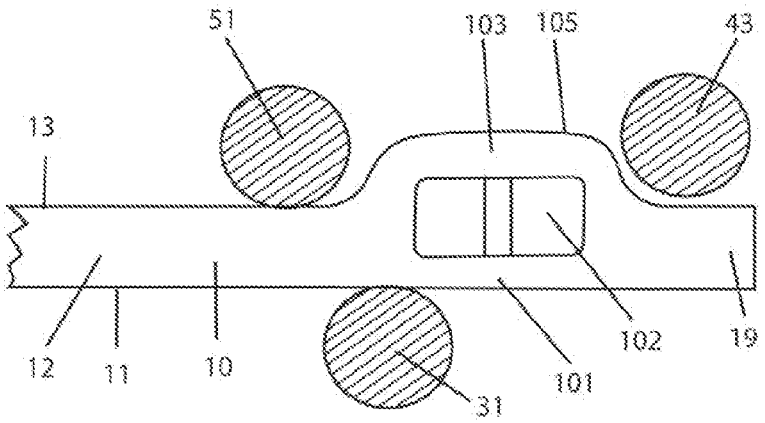
FIG. 19 shows a structure where the swell portion is located between the first section of the middle finger and the third section of the index finger at the chopstick holding status.

FIG. 19 shows an optional example, where the swell portion 105 is located between the first section 51 of the middle finger and the third section 43 of the index finger at the chopstick holding status. In such case, the swell portion does not change the position of the third section 43 of the index finger.

Figure 9:
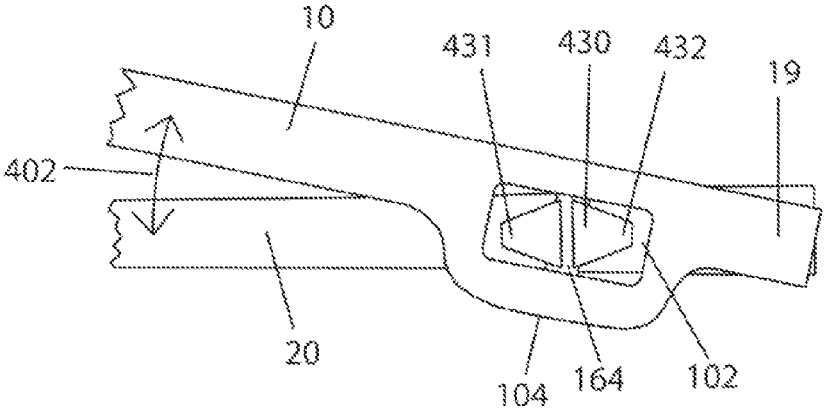
FIG. 9 is a top view showing the C-shaped element mounted on the pivot in the hinge hole.

In the chopsticks disclosed in WO 2011/015033A1, the internal diameter of the C-shaped element is greater than the outer diameter of the pivot, so that the upper chopstick member can turn side way in order to train the coordination of muscles of user's hand. Such arrangement may optionally be applied to the present invention. In the example shown in FIG. 9, the head 431 and tail 432 of the C-shaped element (i.e., the hinge head) are thinner than the hinge hole 102, so that the upper chopstick member 10 can turn side way, and thus form an angle 402 relative to the lower chopstick member 20. The term "head/tail" of the hinge head means these ends are in the same direction as the head/tail of the chopsticks respectively. With the swell portion 104 and/or 105, the central part 433 of the C-shaped element 430 can be thickened in order to prevent breakage. Otherwise, the C-shaped element 430 would be more prone to be broken, in particular in regions of head 431 and tail 432. Optionally, the hinge hole can be wider than the central part of the C-shaped element 430 in order to further increase the angle of side turn.

In the following some embodiments of the structure of the hinge mechanism are illustrated, which can cooperate with the swell portion according to the present invention.

Figure 10:
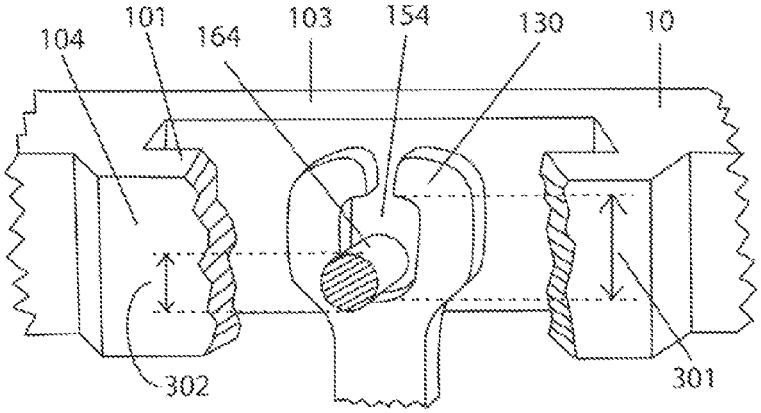
FIG. 10 shows the structure of a C-shaped element with a heightened inner chamber.

FIG. 10 shows the cut-open view of the upper chopstick member 10. In this example, the height 301 of the inner chamber 154 of the C-shaped element 130 is greater than the height 302 of the pivot 164, so that the pivot 164 can move up and down within the inner chamber 154. Accordingly, the distance between the upper chopstick member 10 and the lower chopstick member 20 can be adjusted so as to suit for different hand sizes, and users have to coordinate the muscles of the hand in order to keep the upper chopstick member 10 in the correct position, instead of relying on the fixed position of the pivot to maintain the correction position, thus the users can be better trained. Together with the above mentioned swell portion 104, the hinge mechanism of the example can be designed in a flexible way. In a preferred embodiment, the height 301 of the inner chamber 154 of the C-shaped element 130 is at least 1 mm greater than the height 302 of the pivot 164, so that the pivot 164 can move up and down within the inner chamber 154 with a play of at least 1 mm, which is far more than a common manufacture tolerance. Another possible implementation is that the height 301 of the inner chamber 154 of the C-shaped element 130 is at least 2 mm greater than the height 302 of the pivot 164, so that the pivot 164 can move up and down within the inner chamber 154 with a play of at least 2 mm. Obviously, this arrangement may also be applied to an upper chopstick element with swell portion 105 which protrudes from the back surface of the upper chopstick element (see FIGS. 7 and 8).

Figure 11:
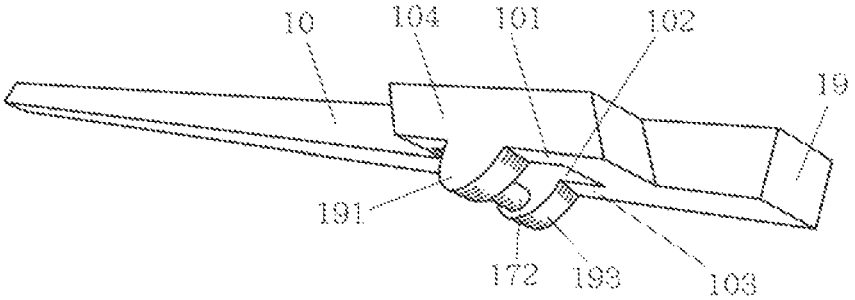
FIGS. 11 to 14 show a projection arranged on the bottom surface of the upper chopstick member in addition to the swell portion.
Figure 12:
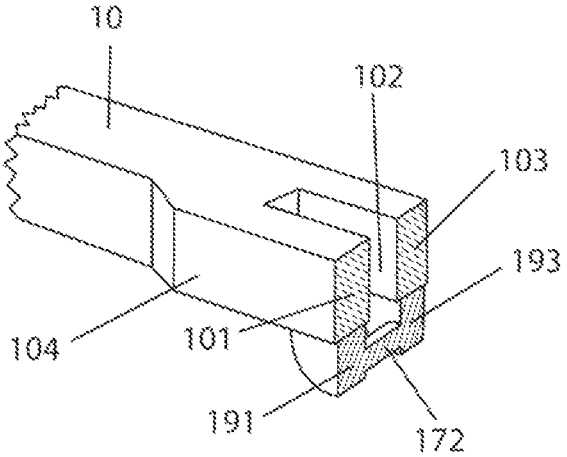
Figure 13:
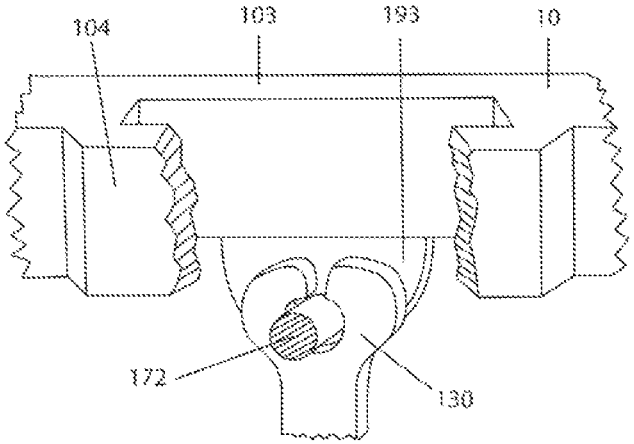

In addition to the swell portion extending along the front-back direction of the chopsticks, one or more projections extending downwardly from the bottom surface of the upper chopstick member 10 are also possible. FIG. 11 shows such an example, where the upper chopstick member 10 is provided with two separated projections 191 and 193, which respectively extends downwardly from the bottom surface of the front wall 101 and the bottom surface of the back wall 103, and a pivot 172 is located between the two projections. FIG. 12 shows the cross sectional view of the structure of FIG. 11 along the longitudinal direction. FIG. 13 shows the cut-open view of the structure of FIG. 11 and the C-shape element 130 in the assembly status.

Figure 14:
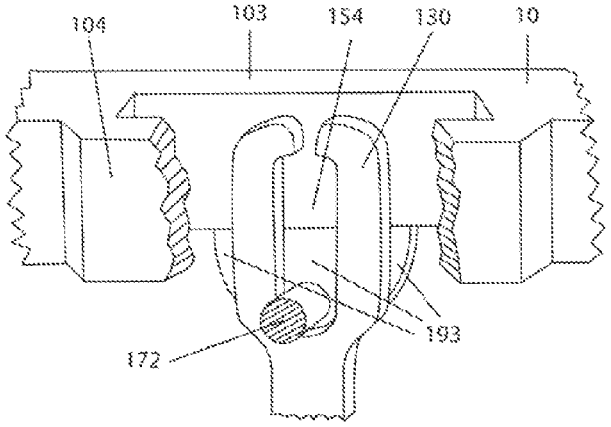

FIG. 14 is a variant of the FIG. 13. In this case, the height of the inner chamber 154 of the C-shaped element 130 is greater than the height of the pivot 172, preferably by at least 1 mm, in particular 2 mm, so that the upper chopstick element can move up and down at such distance. The pivot 172 and thus the upper chopstick member 10 can move up and down in a considerable range. One of the benefits of this structure is that the hinge head 130 does not have to protrude at a long distance from the top of the upper chopstick element, and still, the pivot can move up and down at such considerable range. The user would also need to coordinate the muscles of the hand. In particular case, the hinge head 130 do not protrude from the top of the upper chopstick element.

Figure 15:
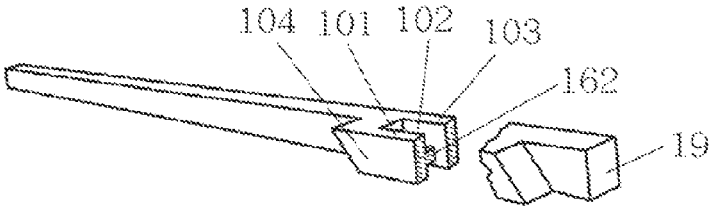
FIGS. 15 to 17 show three types of pivot arranged within the hinge hole.
Figure 16:
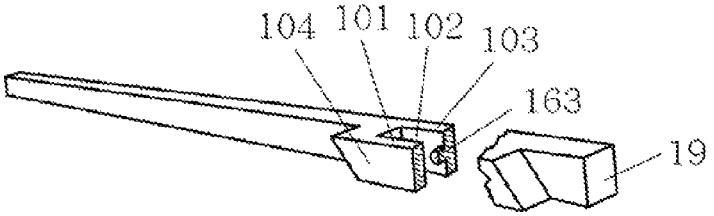
Figure 17:
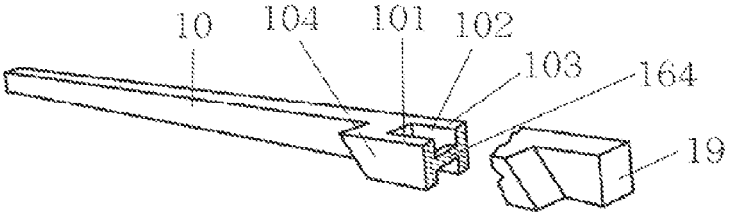

FIGS. 15 to 17 show three examples of the pivot. As shown in FIG. 15, the pivot 162 is located on the front wall 101 of the swell portion 104 only. FIG. 16 shows a pivot 163 that is located on the hack wall 103 of the swell portion 104 only. In the example shown in FIG. 17, the pivot 164 can connect the front wall 101 with the back wall 103.

Figure 18:
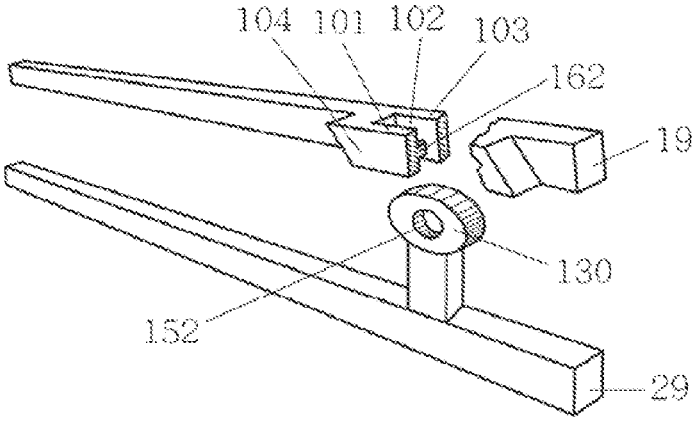
FIG. 18 shows a ring-shaped element of the hinge mechanism according to the present invention.

Optionally, the hinge head can be formed in manners other than C-shaped element, such as a ring-shaped element as shown in FIG. 18. It can be understood for one skilled in the art that the ring-shaped element can be manufactured in conventional manners.

Although the accompany drawings show the chopsticks for right hand, the present invention can be also applied for chopsticks for left hand.

In the foregoing some preferred examples of the present invention is explained in details. It can be understood that the present invention is not limited to the said examples mentioned above. Instead, those skilled in the art can, after reading the present invention, make modifications, changes or omissions, which certainly fall within the scope of the present invention.

The invention claimed is:

1. Chopsticks, comprising a lower chopstick member, an upper chopstick member and a hinge mechanism connecting the lower and upper chopstick members, wherein the hinge mechanism comprises a hinge arranged on the lower chopstick member and a hinge hole in the upper chopstick member, the opening of the said hinge hole being arranged on the bottom surface of the upper chopstick member, the hinge comprises a hinge head which is provided with an inner chamber and can be received into said hinge hole through the said opening of the hinge hole, and the hinge hole is provided with a pivot that can be received in the inner chamber, so that the hinge can turn around the pivot, and the upper chopstick member is provided with a swell portion, in which the hinge hole is located, and the swell portion extends from the front surface of the upper chopstick member and/or the back surface of the upper chopstick member.

2. The chopsticks according to claim 1, wherein the swell portion extends from the front surface of the upper chopstick member and/or the back surface of the upper chopstick member at a distance of more than 1 mm, in particular more than 2 mm.

3. The chopsticks according to claim 1, wherein at the chopsticks holding status, the third section of the index finger is positioned within the region of the hinge hole.

4. The chopsticks according to claim 1, wherein the swell portion is located on the front surface of the upper chopstick member between the ulnar side of the first section of the thumb and the tail of the upper chopstick member at chopstick holding status.

5. The chopsticks according to claim 1, wherein the swell portion extends from the front surface of the upper chopstick member, and is arranged so that at the chopsticks holding status, it contacts ulnar side of the thumb.

6. The chopsticks according to claim 1, wherein the hinge head is a C-shaped element or a ring-shaped element.

7. The chopsticks according to claim 1, wherein the inner chamber formed in the hinge head has a height greater than the height of the pivot.

8. The chopsticks according to claim 7, wherein the inner chamber has a height at least 1 mm, in particular at least 2 mm, greater than the height of the pivot, so that the pivot can move up and down at least such distance.

9. The chopsticks according to claim 1, wherein the upper chopstick member is further provided with two separated projections extending from the bottom of the front wall and back wall of the hinge hole, and the pivot is arranged between the two projections.

10. The chopsticks according to claim 1, wherein the pivot is mounted on the front wall and/or the back wall of the hinge hole.

11. The chopsticks according to claim 1, wherein the hinge head is supported by a hinge rod extending from the top surface of the lower chopstick member.

12. The chopsticks according to claim 1, wherein the total thickness of the front wall and back wall of the hinge hole and the hinge head is greater than the thickness of the upper chopstick element, preferably by at least 1 mm, in particular by at least 2 mm.

13. The chopsticks according to claim 1, wherein the hinge head does not protrude from the top surface of the upper chopstick element.

14. The chopsticks according to claim 1, wherein the swell portion extends rearwardly from back surface of the upper chopstick member, and is located between first section of the middle finger and the third section of the index finger at chopstick holding status.

15. The chopsticks according to claim 1, wherein the swell portion is formed integrally with the upper chopstick member by injection molding.

16. The chopsticks according to claim 1, wherein the head and tail of the hinge head are both thinner than the hinge hole.

* * * * *